US006503022B1

(12) United States Patent
Nuss

(10) Patent No.: US 6,503,022 B1
(45) Date of Patent: Jan. 7, 2003

(54) BOUYANT MOON POOL PLUG

(75) Inventor: W. Philip Nuss, Covington, LA (US)

(73) Assignee: Halter Marine, Inc., Gulfport, MS (US)

( * ) Notice: Subject to any disclaimer, the term of this patent is extended or adjusted under 35 U.S.C. 154(b) by 0 days.

(21) Appl. No.: 09/640,323

(22) Filed: Aug. 16, 2000

(51) Int. Cl.[7] ..... B63B 9/12
(52) U.S. Cl. ..... 405/195.1; 114/201 R
(58) Field of Search ..... 405/195.1, 205, 405/216, 154.1; 114/322, 201 R, 361, 382, 258; 222/563; 441/21

(56) References Cited

U.S. PATENT DOCUMENTS 4,435,108 A 3/1984 Hampton
4,448,568 A 5/1984 Gentry et al.
4,478,586 A * 10/1984 Gentry et al. ..... 141/388
4,892,495 A * 1/1990 Svensen ..... 114/230.12
5,013,186 A 5/1991 Kakizaki
5,697,732 A * 12/1997 Sigmundstad ..... 141/279
5,860,840 A * 1/1999 Boatman et al. ..... 114/230.12
6,155,193 A * 12/2000 Syvertsen et al. ..... 114/230.12
6,257,801 B1 * 7/2001 Kelm et al. ..... 405/195.1
6,341,450 B1 * 1/2002 Macander et al. ..... 114/117

FOREIGN PATENT DOCUMENTS

JP 61-132495 * 6/1986
JP 8-119190 * 5/1994

* cited by examiner

*Primary Examiner*—Gary S. Hartmann
(74) *Attorney, Agent, or Firm*—Len R. Brignac

(57) ABSTRACT

A vessel having a moon pool positioned in the center of the vessel. The moon pool plug is adapted to have controllable positive and negative buoyancy. The plug has a top, a cover, a bottom, a first angled side, a second angled side, a third angled side, a fourth angled side; first plates disposed traversely across the bottom of the plug; and second plates disposed perpendicular to said first plates across the bottom of the plug. These is a water valve for permitting sea water to egress from the plug; an air valve for permitting air to be pumped into the plug. There is a guiding device secured to the plug to guide the plug into the moon pool. There is a hoist secured to the plug to lift the plug into the desk of the vessel.

9 Claims, 6 Drawing Sheets

BOUYANT MOON POOL PLUG

FIELD OF THE INVENTION

This invention relates to a vessel having a moon pool which is commonly used for laying pipe or laying fiber optic cable or for drilling wells under the sea. In typical ships, the moon pool is closed by using conventional hinged doors. These doors have various types of appendages which often snarl and snag on hydraulic cables and electrical connection lines as the pipe is being laid, or as divers use the moon pool. The present invention was developed to prevent the snagging of cables and lines while enabling the moon pool to be effectively used by eliminating the need for doors.

BACKGROUND OF THE INVENTION

Numerous vessels have been build using moon pools. These vessels include cable-laying vessels, pipe laying vessels and drilling vessels. The moon pool is a round hole, open to the sea, located amidships into which the pipe or cable is fed. Ships with moon pools have been reported in various patents, see for example, U.S. Pat. Nos. 4,435,108, 5,013,186, which is directed towards a cable ship, U.S. Pat. 4,448,568 which is a marine facilities work station with a moon pool.

When the ship wants to leave a site, the moon pool is typically closed, with hatches. These hatches are often large door like objects which are hinged to the sides or bulkheads of the vessels. The hatches have pins and objects which protrude outwardly when not locked together. These outwardly producing members have caused snagging and trouble in the industry. The present invention was created to provide an easy to use device for sealing a moon pool so that the vessel can quickly get underway with the minimum of snagging of lines.

SUMMARY OF THE INVENTION

The present invention tends to resolve the aforementioned problems in the prior art, and it is one object of the prevent invention to provide a vessel which can be plugged with a buoyant moon pool plug without the need for hatches.

According to one feature of the present invention there is provided a ship including a moon pool plug which has (a) interior plates for strength, (b) means for receiving and expelling air and sea water for deballasting and positive buoyancy, (c) guide means to orient the plug while under water and while rising to the moon pool, and (d) hoisting means to lift the plug onto the deck of the vessel.

The invention relates to a vessel, comprising a moon pool positioned in the center of the vessel, a buoyant moon pool plug adapted to have controllable positive and negative buoyancy; with the plug comprising: a top; a cover; a bottom; a first angled side; a second angled side; a third angled side; a fourth angled side with the first plates disposed traversely across the bottom of said plug; and the second plates disposed perpendicular to the first plates across the bottom of said plug: a water valve for permitting sea water to egress from said plug; a air valve for permitting air to be pumped into said plug; guide means secured to the buoyant moon pool plug to guide said plug into the moon pool; and hoisting means secured to the plug to lift the plug into the desk of the vessel.

The invention also relates to a method for installing a buoyant moon pool plug in a moon pool of a vessel that comprises the steps of: securing a guide means to the plug; moving plug into the sea; submerging and deballasting plug in the sea by filling the plug with sea water; positioning the plug with respect to the vessel beneath the hull and the moon pool; orienting the plug with guide means, and expelling the sea water from the plug enabling the buoyant moon pool plug to have positive buoyancy and to rise into the moon pool of the vessel.

The above mentioned and other objects, features and advantages of the present invention will become more apparent by referring to the following description of one preferred embodiment of the invention made in conjunction with the accompanying drawings.

BRIEF DESCRIPTION OF THE DRAWINGS

A specific embodiment of the invention will be described by way of example with reference to the accompanying drawings, in which.

DESCRIPTION OF THE PREFERRED EMBODIMENT

The Vessel

Figure 1:
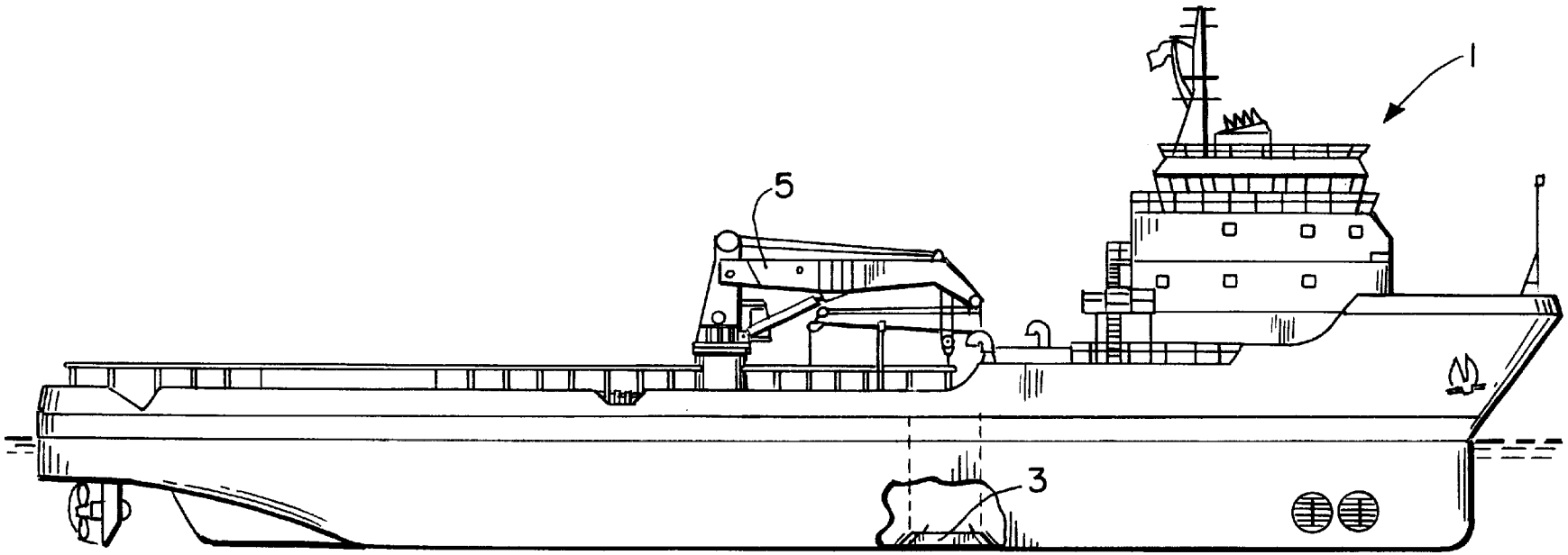
FIG. 1 is a side view of a vessel with a moon pool.
Figure 2:
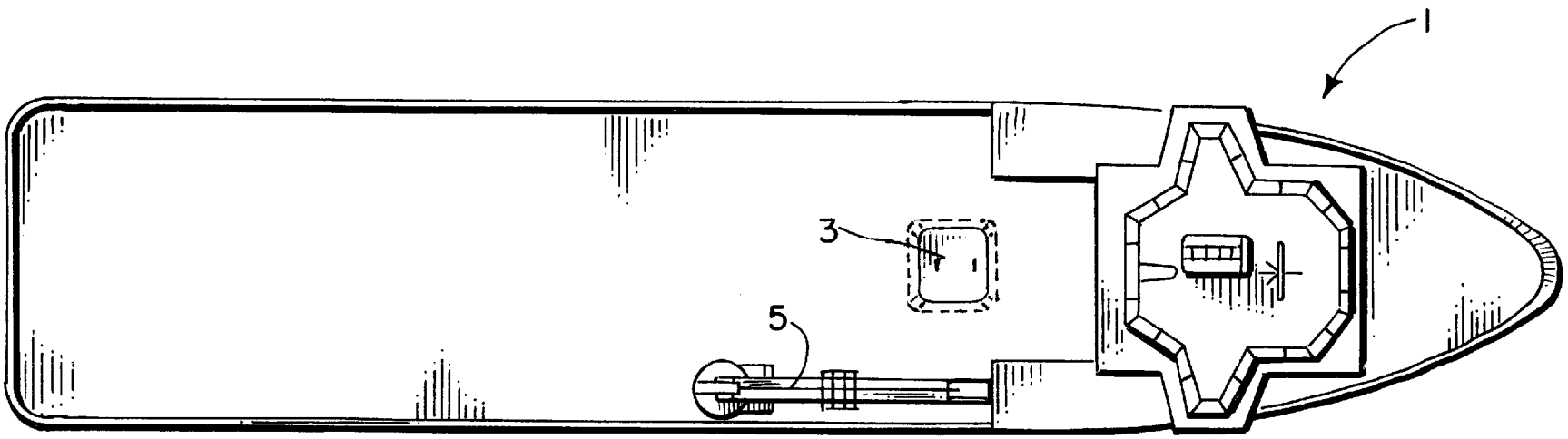
FIG. 2 is a top view of a vessel with a moon pool.

Various vessels (1) shown in FIG. 1 can be used within the scope of this invention. Cable laying ships can be used with the buoyant moon pool plug, as can pipe laying ships having at least one moon pool (3) as shown in FIG. 2. One or two moon pools can be used on a ship and respectively, one or two moon pool plugs can be used. Semi-submersible drilling vessels can be used with the buoyant moon pool plug as a safety device, to plug holes created in the legs or hulls if they are hit by a hurricane or freighter. The plug can be positively ballasted to plug the moon pool or to plug other holes which are made of substantially the same diameter as the plug.

As shown in FIGS. 1 and 2, the invention relates to a vessel (1) having a moon pool and a crane (5) for lifting or hoisting the plug onto the deck. The moon pool (3) extends vertically from the vessel's main deck to open with the bottom ends below the waterline of the vessel.

The Moon Pool

This invention is devised for use with generally square moon pools which are usually located substantially midships of the vessel. The plug can be any shape which works with a vessel's moon pool.

Most moon pools are shaped having sides which are angled. Accordingly the moon pool plug is devised with angled sides to fit into the pool with the minimum of contact to anti-fouling paint used on the moon pool.

The Buoyant Plug

Figure 3:
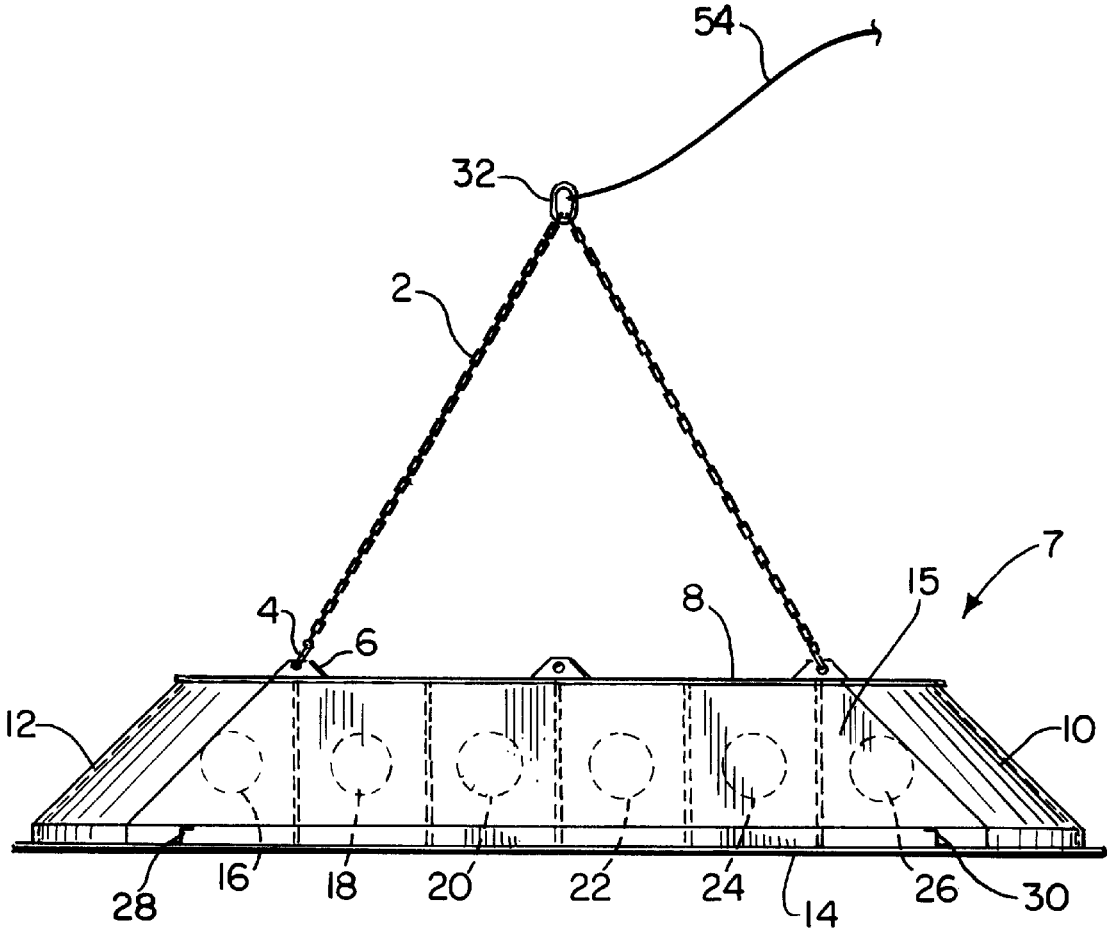
FIG. 3 is a side view of the moon pool plug with the hoisting means attached.

As shown in FIG. 3, the plug (7) has a top (8), which is referred to as a closing plate, and four sloped sides, two of which are visible in this figure, a first sloped side (10) and a second sloped side (12). The sides have rounded corners. The plug also has a bottom (14). The bottom (14) is opposite the top and forms a cavity (15). Various support plates are welded into the cavity. The plates are known as web plates, intercostal plates and rider plates. Lightening holes can be created in the plates to make the plug less heavy for lifting. Lightening holes (16), (18), (20), (22), (24) and (26) are shown in FIG. 3.

The plug can be hoisted using chain (2) which is typically ½ inch chain. The chain can be secured to any number of attaching means. In the preferred embodiment, chain (2) is secured to shackle (4). The shackle is attached to a pad eye or similar structure for lifting the plug. At the opposite end, the chain (2) is secured to a ring (32). Ring (32) can be connected to a guide wire (54). Guide wire (54) is used to maneuver the plug while hoisting the plug, or while the plug is semi or totally submerged in the sea. Cranes or derricks can be used to hoist the plug into the moon pool or alternatively onto the deck of the vessel, or a nearby barge for storage when not in use.

In the preferred embodiment, the plug further uses angle stiffeners (28) (30) attached to various points on the plug, preferably at the bottom of the plug (7) to add strength to the overall structure of the plug. Any number of stiffeners can be used on the plug, depending on the size of the plug. In the most preferred embodiment of the plug, which is a 16×16-foot size, up to 16 stiffeners can be welded onto the plug bottom for added strength.

The plug itself is preferably a metal sealed object. Steel is the most preferred metal to be used, but coated metals can be used within the scope of the invention. It is within the scope of the invention to use other very strong materials as the plug as well, such as reinforced fiberglass. The chains used with the plug are preferably metal, such as steel. In the most preferred embodiment, they are coated steel.

The plug can be moved using the guide means, or by divers using acoustic beacons or flashing lights to locate the position beneath the vessel which is ideal prior to hoisting the lug into the moon pool.

Figure 4:
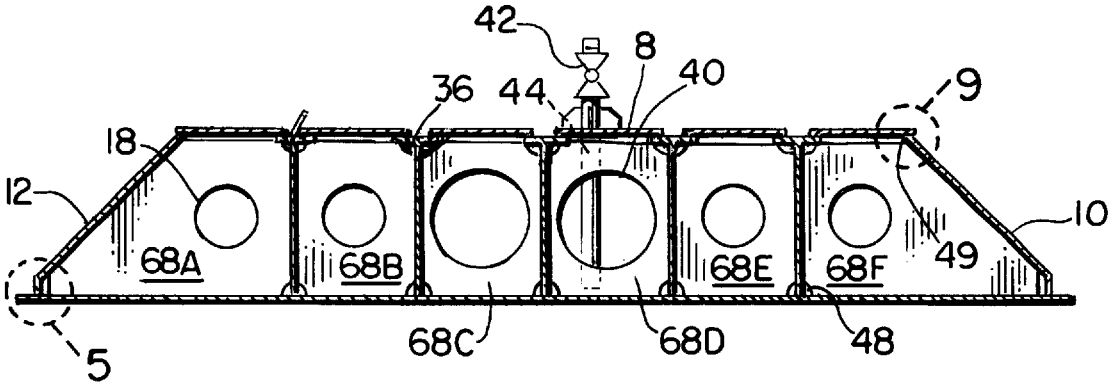
FIG. 4 is a cross sectional view of the plug.

FIG. 4 shows the plug with seawater valve (42) located on the top of the plug (8). Seawater valve (42) permits seawater to enter or egress from the plug. A second valve, air valve (46) which is shown in FIG. 6 permits air to enter the plug or exist the plug.

FIG. 4 shows the plates **(68*a*), (68*b*), (68*c*), (68*d*), (68*e*), and (68*f*) to prevent stress concentration in any one portion of the plug as it is used and hoisted. Intersecting these plates 68** *a* to *f* are plates which run the continuous length of the plug from one end to the other. A pipe (44) is connected preferably, via a quick disconnect to valve (42) to deballast the plug. The previously mentioned lightening holes can modified in another embodiment to be manholes, one of which is noted as hole (40). Scallops are welded to various positions on the top plate. Scallop (36) and (48) are shown as welding details to prevent stress concentrations on the plug. Top joint (49) is an optional reinforced joint that shows how the closing plate fits with the top plate.

Figure 5:
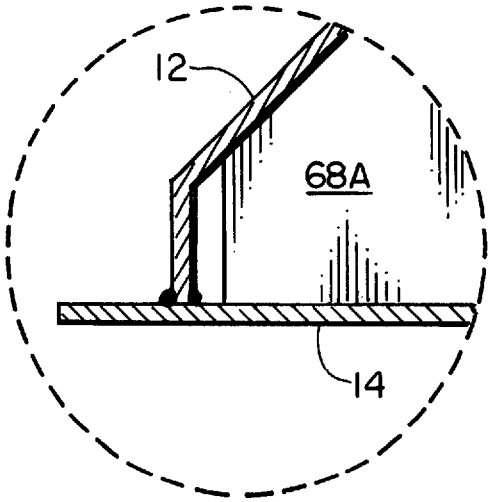
FIG. 5 is a detail of the support scallops wielded to the plug.

FIG. 5 shows a welding detail on the plug sloped side 12.

Figure 6:
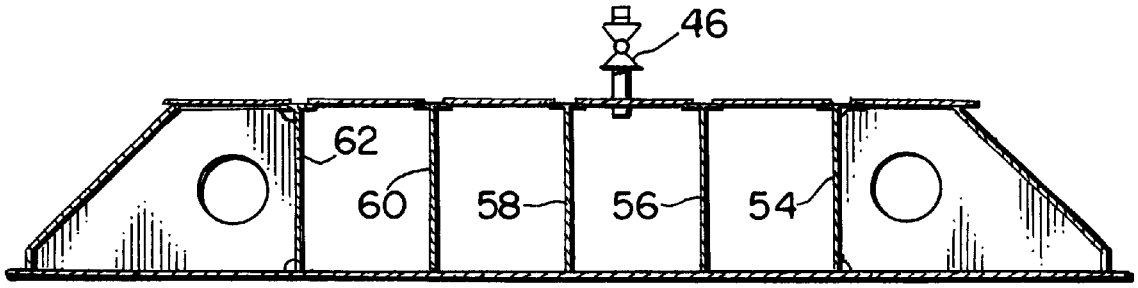
FIG. 6 is a cross section of the plug showing the value to permit air into the plug.

FIG. 6 shows how the valve 46 is connected to the top of the plug and the various plates, 62, 60, 58, 56, and 54 welded to the bottom of the plate. In addition, welding details are shown.

Figure 7:
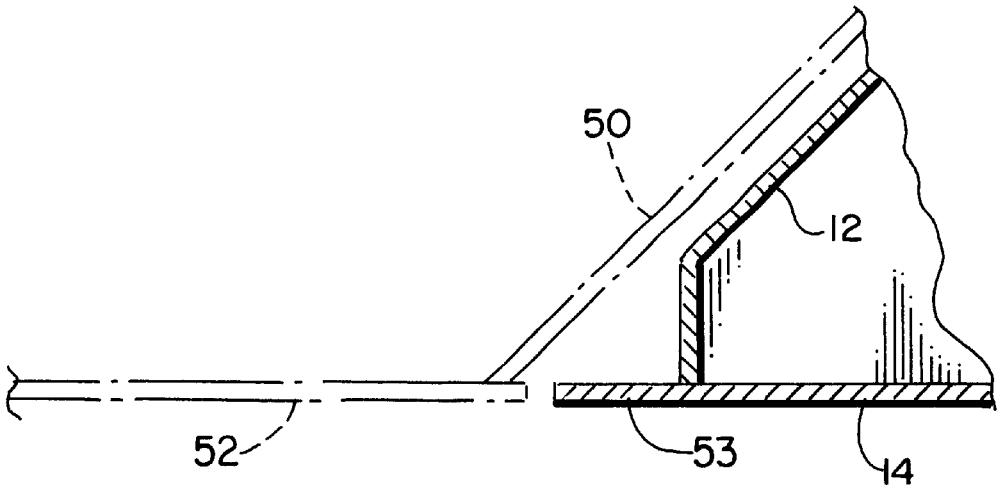
FIG. 7 is a detail of how the moon.

FIG. 7 shows how the plug fits into the moon pool. In particular, sloped side 12 is parallel to moon pool bulkhead 50 but does not touch the side of the moon pool bulkhead. The plug, has a tapered side which allows more clearance until the plug is fitted into the final position in the moon pool. The sloped sides of the moon pool 50 are angled from the hull bottom 52 between 40 and 60 degrees. Guide means 53 is used to prevent the plug from rubbing against the sides of the moon pool at all positions. The rubbing would rub off anti-fouling paint used on the moon pool which would require more maintenance for the moon pool.

Figure 8:
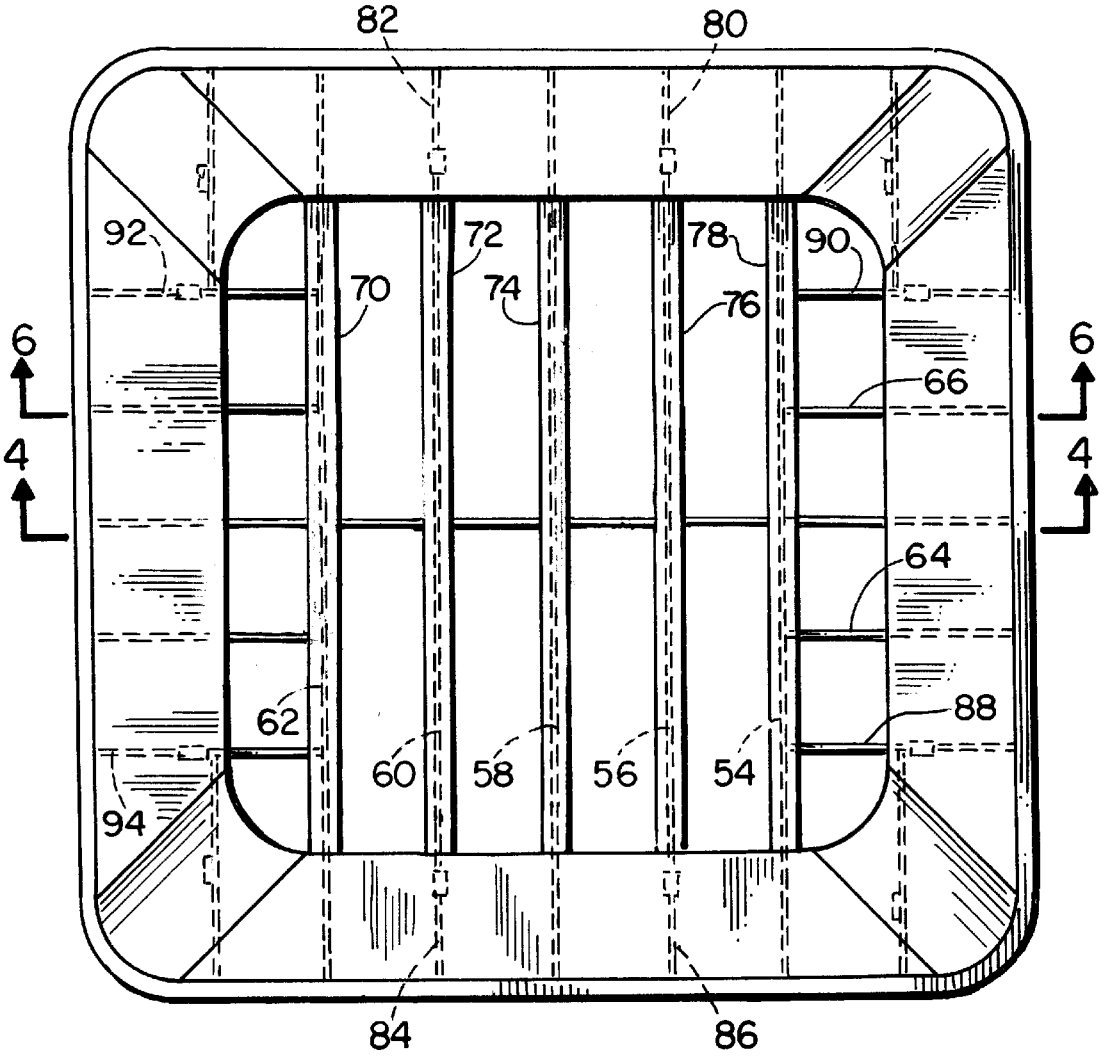
FIG. 8 is a top view of the moon pool plug.

FIG. 8 shows a top view of the plug. In this embodiment of the plug, the shape is generally square with rounded edges. Preferred dimensions for the plug are:

A top surface of 12 feet by 12 feet;

A bottom surface of 16 feet by 16 feet;

An overall plug height of 30 to 40 inches from bottom to top, and

Four sloping sides, which are at an angle of slope of between 30 and 60 degrees, preferably 45 degrees from the plane in which the bottom of the plug is located. A typical plug would have a clean mounting surface of non-corrosive material to be provided at the mating surface with the moon pool to prevent contact to the moon pool bulkheads to minimize deterioration of the coating placed on both the plug and the moon pool bulkhead.

A first set of plates, known as web plates are shown as plates (56), (54) (58), (60), and (62). Perpendicular to the web plates are rider plates (70), (72), (74), (76), and (78) as shown in the Figure. Preferably the web and rider plates are made from 6 inch×½ inch flat bar.

Intercostal plates are shown as (80), (82), (84), (86), (88), (90), (92) and (94). These plates are perpendicular to the web plates.

Closing plate (8) is preferably plug welded on to the other plates but it can be solid welded from the inside of the plug as well.

Plates (64), (66) and (68) are perpendicular to plates (54), (56) and (58). Plates (64) and (66) do not run the entire length of the plug. Plate (68), which is actually a plurality of individual plates, **(68*a*), (68*b*), (68*c*), (68*d*), (68*e*) and (68*f*) traverses the entire length of the plug. Plates (64) and (66)** are short to reduce the weight of the plug and the cost of the plug while enabling support to be provided which gives adequate strength to the plug.

Figure 9:
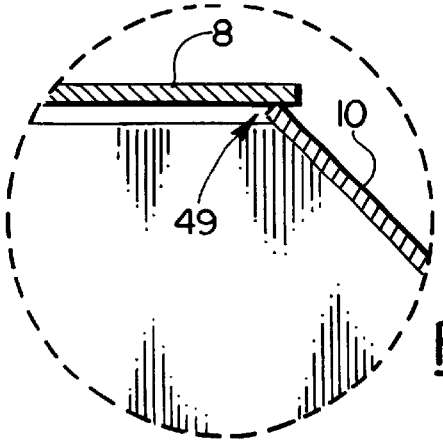
FIG. 9 is a view of the slope of the welded edge of the plug.

FIG. 9 shows how the closing plate (8) fits over the sloped side (10).

Additionally, it is within the scope of the invention to use leveling means, which can a sensor to detect attitude and position of the plug within the moon pool.

It is considered within the scope of the invention that the plug can be anchored to the seabed at an offshore site when not in use on the vessel through the positive ballasting means described herein.

It is also considered that the invention can be used to lift subsea-drilling equipment, such as a distressed ROV from a lower under water position into the moon pool, using the positive buoyancy concept.

While a principle of the present invention has been described above in connection with one preferred embodiment of the invention, it is intended that all matter contained in the above description and illustrated in the accompanying drawings shall be interpreted to be illustrative of and not as a limitation on the scope of the invention as defined by the appended claims.

What is claimed is:

1. A vessel, comprising:

(a) a moon pool positioned in the center of the vessel;

(b) a buoyant moon pool plug adapted to have controllable positive and negative buoyancy; said plug comprising:

a top;

a cover;

a bottom;

a first angled side;

a second angled side;

a third angled side;

a fourth angled side;

first plates disposed traversely across the bottom of said plug; and second plates disposed perpendicular to said first plates across the bottom of said plug;

(c) a water valve secured to said top for permitting sea water to egress from said plug;

(d) an air valve secured to said top for permitting air to be pumped into said plug;

(e) guide means secured to said plug to guide said plug into said moon pool; and (d) hoisting means secured to said plug to lift said plug into the deck of said vessel.

2. The vessel of claim 1, wherein said moon pool has angled bulkheads into which the buoyant plug can securely fit.

3. The vessel of claim 1, wherein said vessel is a drilling ship.

4. The vessel of claim 1, wherein said vessel is a cable laying ship.

5. The vessel of claim 1, wherein said vessel is a floating production storage and offloading vessel.

6. The vessel of claim 1, wherein said vessel is selected from the group comprising: an oceanographic research vessel; a dive support vessel; a hydrographic survey ship, and ocean surveillance vessel, a fisheries research vessel; and a well stimulation vessel.

7. The vessel of claim 1, wherein said plus has a first, second, third and fourth angled side having an angle of slow between 40 and 60 degrees from the plane of the bottom of the plug.

8. The vessel of claim 1, wherein said vessel is a semi-submersible drilling platform.

9. The vessel of claim 1, wherein said moon pool plug is substantially square.

* * * * *